US005181832A

United States Patent [19]

Reents

[11] Patent Number: 5,181,832

[45] Date of Patent: Jan. 26, 1993

[54] FAN MOTOR AND AIR HOSE STORAGE HOUSING FOR PORTABLE SPRAY PAINT GUNS

[75] Inventor: Terry R. Reents, Burnsville, Minn.

[73] Assignee: Wagner Spray Tech Corporation, Minneapolis, Minn.

[21] Appl. No.: 737,786

[22] Filed: Jul. 30, 1991

[51] Int. Cl.[5] ..... F04B 21/00; F04B 34/04

[52] U.S. Cl. ..... 417/234; 417/423.9; 417/423.14

[58] Field of Search ..... 417/234, 423.1, 423.2, 417/423.7, 423.9 X, 423.14 X, 423.15, 424.1

[56] References Cited

U.S. PATENT DOCUMENTS 2,532,264 10/1950 Smith ..... 417/423.2

5,094,591 3/1992 Whitley ..... 417/234

*Primary Examiner*—John J. Vrablik
*Assistant Examiner*—Roland McAndrews
*Attorney, Agent, or Firm*—Faegre & Benson

[57] ABSTRACT

A housing for a fan motor for a portable paint spray gun has a compartment accessible from the bottom in which an air hose is storable and provides an air path from the fan motor to the air hose having a minimum number of turns or curves between the motor exhaust port and the air hose. The housing enhances portability by providing convenient storage for the air hose when not in use and increases fan motor efficiency by reducing drag on the air flow by providing a relatively low resistance air path from the fan motor to the air hose.

19 Claims, 5 Drawing Sheets

FAN MOTOR AND AIR HOSE STORAGE HOUSING FOR PORTABLE SPRAY PAINT GUNS

SUMMARY OF THE INVENTION

This invention relates to a housing for a portable spray paint gun fan motor. The housing provides an air path having a minimum number of restrictions such as turns between the fan motor and the air hose to reduce drag on the air flow. The housing also provides a bottom opening compartment for air hose storage.

FIG. *2a* is a fragmentary exploded view of the top of the bottom panel showing the means for fastening the bottom panel to the housing.

Figure 1:
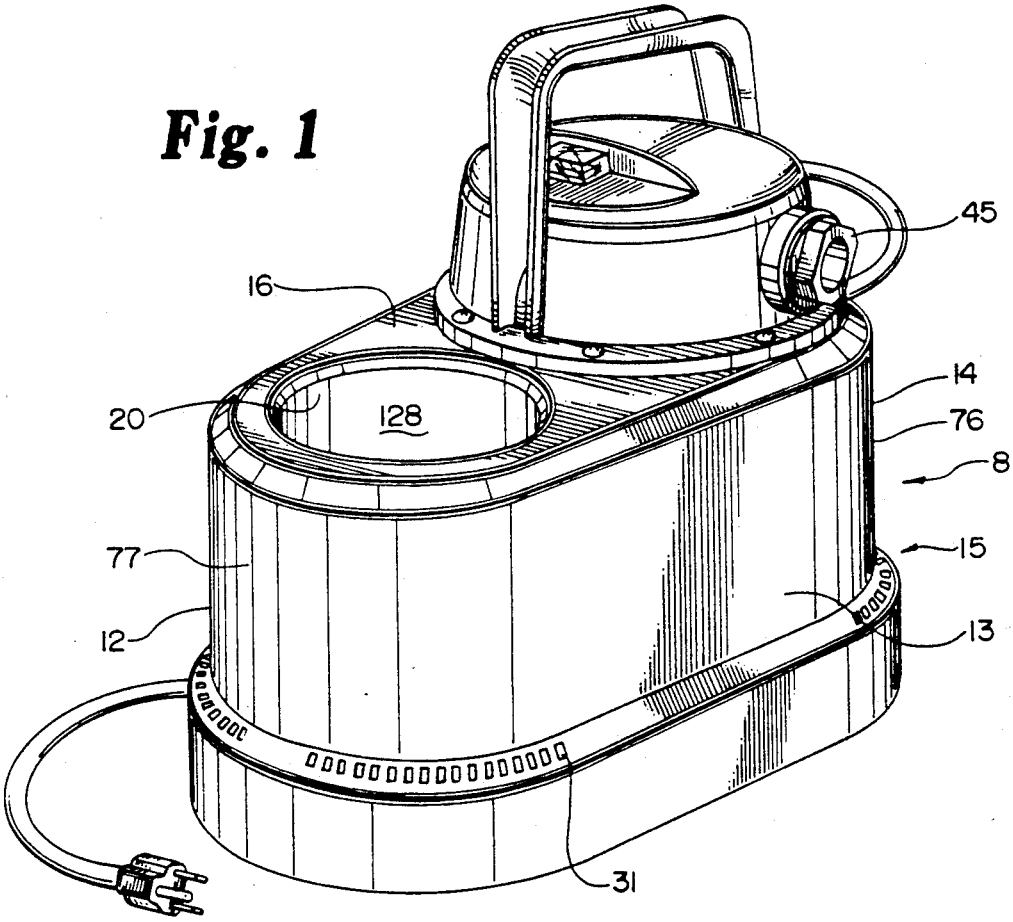
FIG. 1 is a perspective view of the housing.
Figure 3:
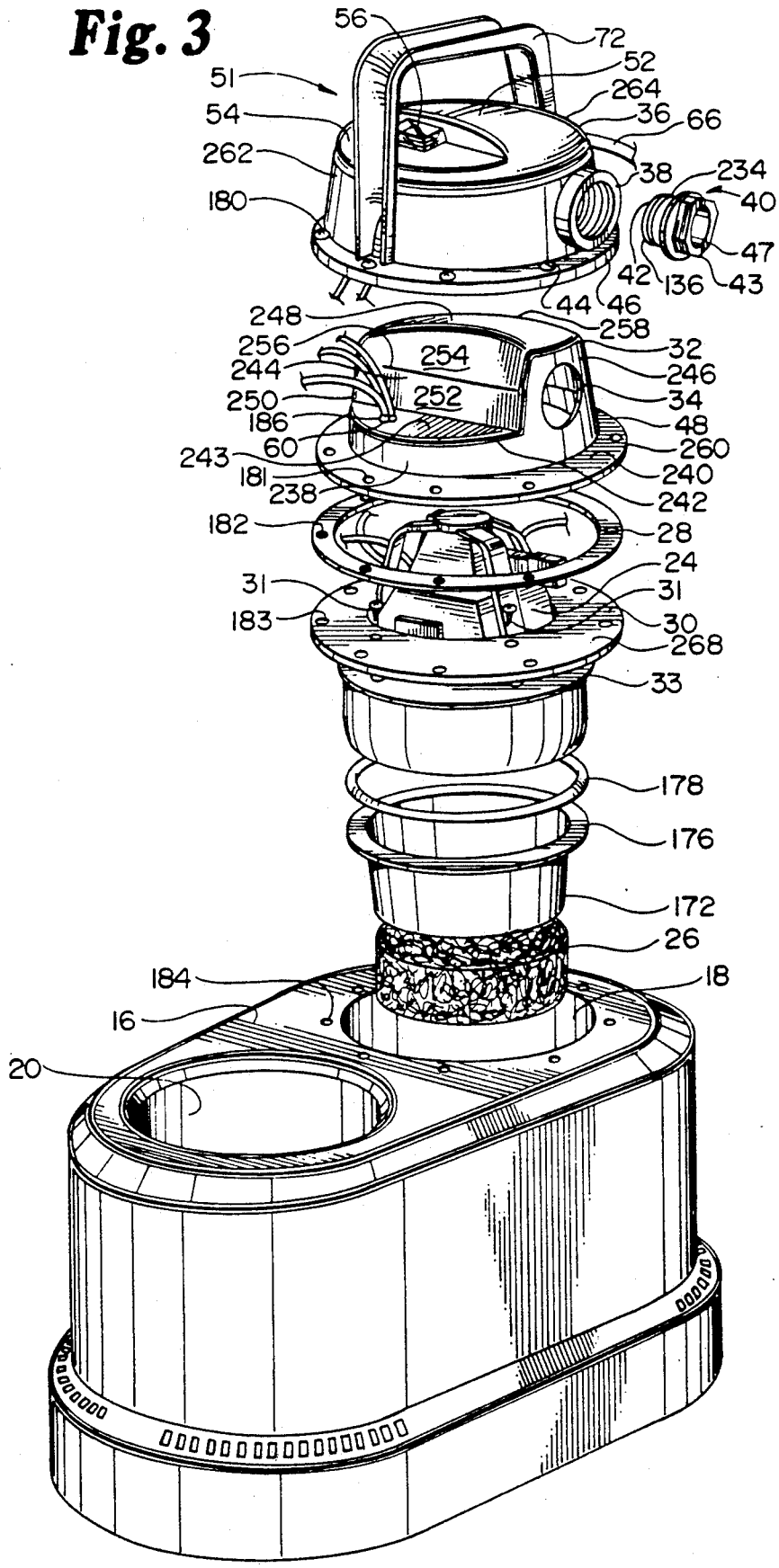

FIG. 3 is an exploded view of the housing shown in FIG. 1.

Figure 4:
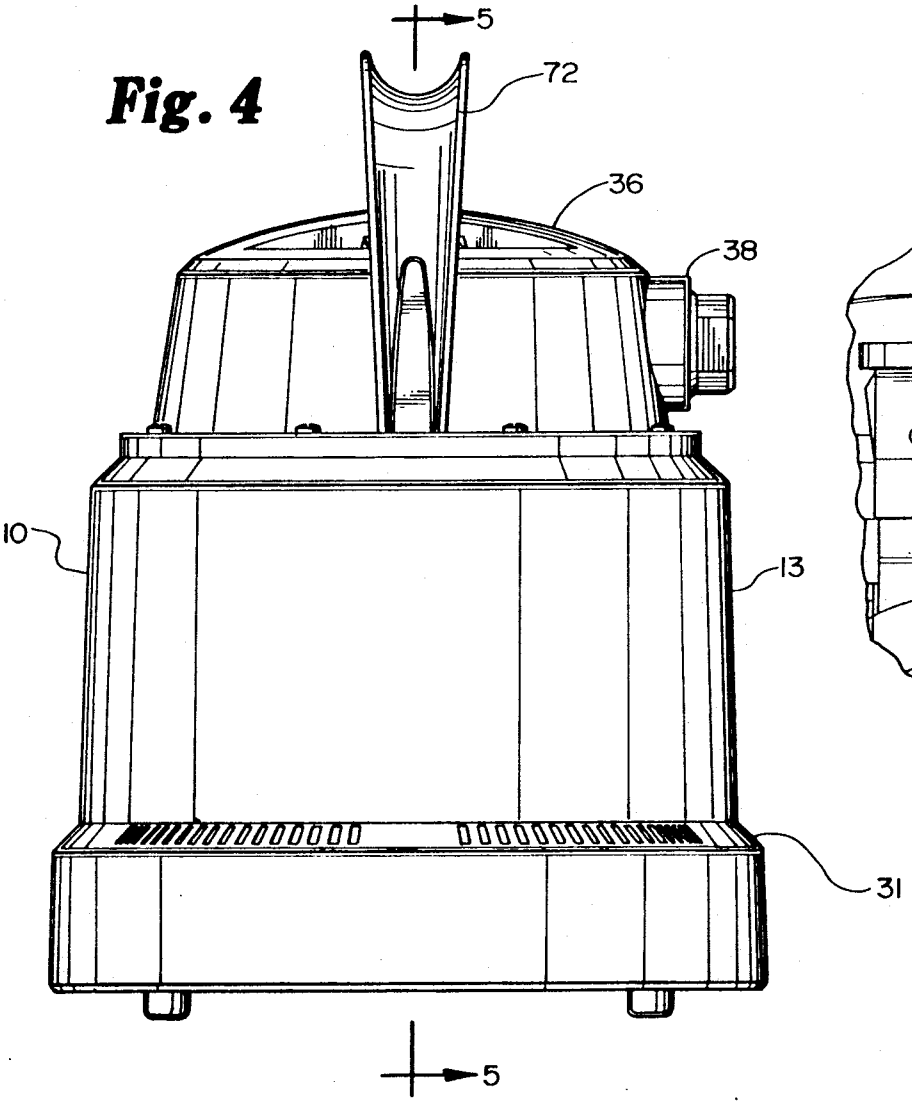

FIG. 4 is an end elevational view of the housing.

Figure 5:
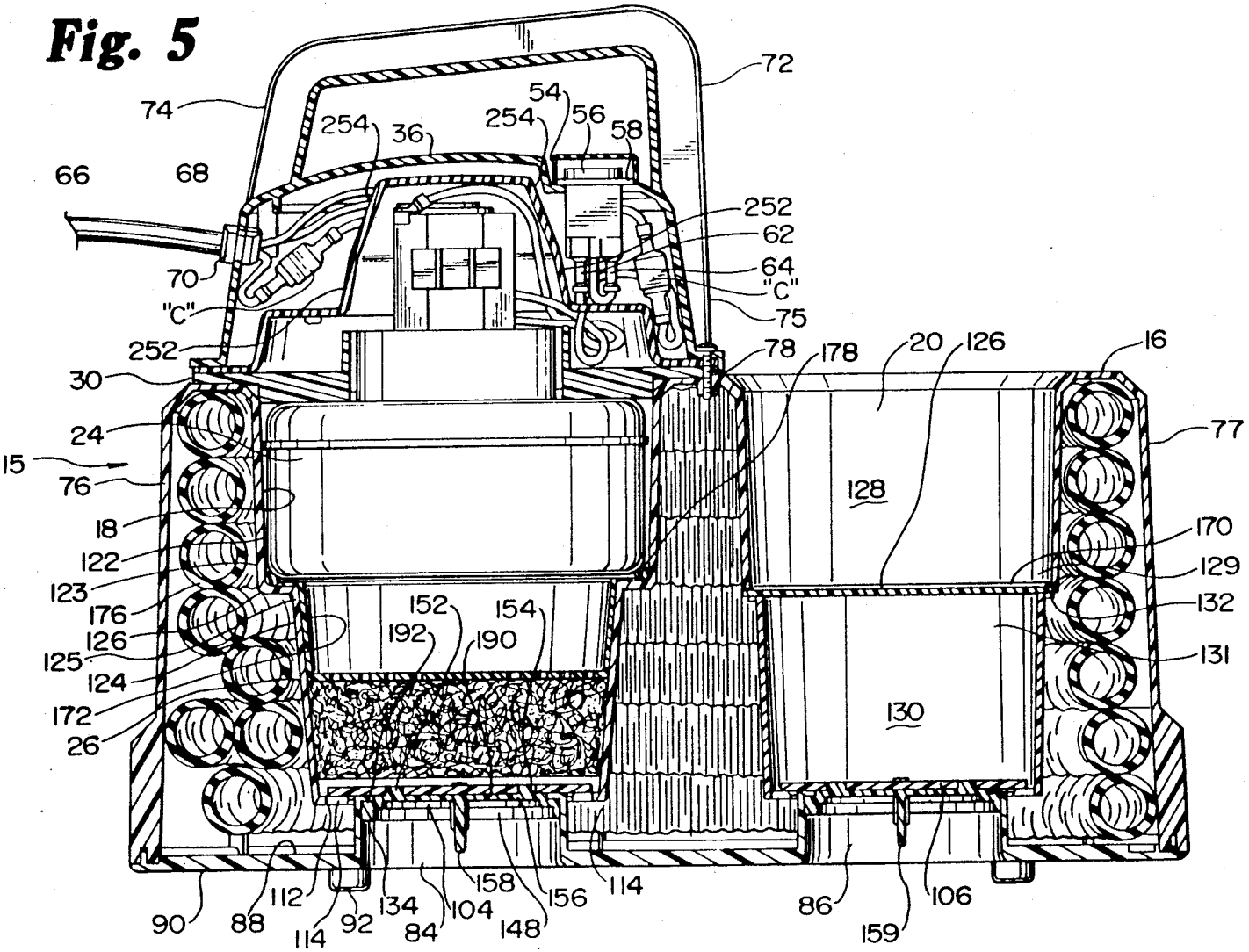

FIG. 5 is a sectional view taken along line 5—5 in FIG. 4; and

Figure 6:
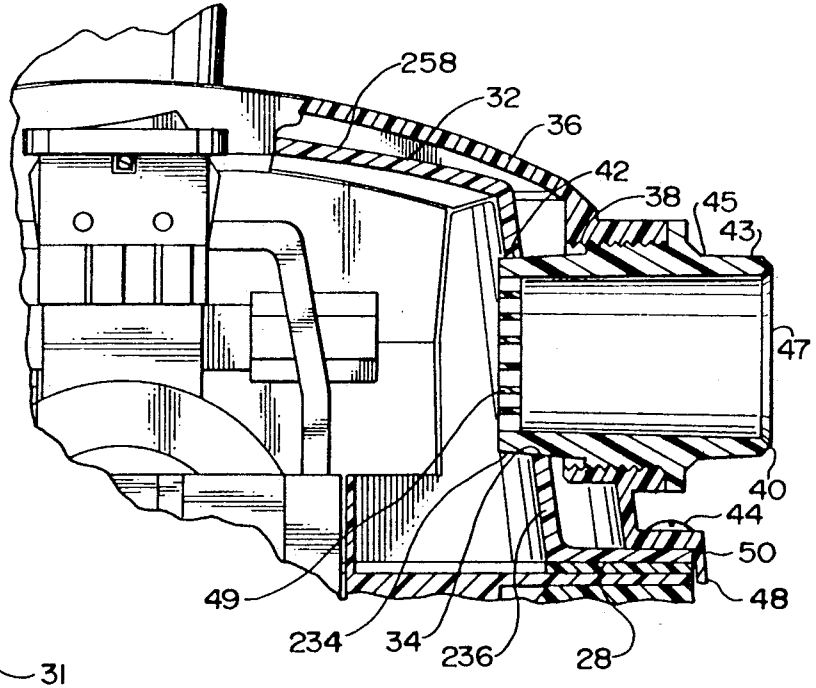

FIG. 6 is a fragmentary section through the air exit fitting and upper dome assembly.

DETAILED DESCRIPTION OF THE INVENTION

Referring to FIGS. 1, 2, 3 and 4, a preferred embodiment of the housing 8 of the present invention is provided with a pair of generally planar vertical sides 10 and 13 and a pair of generally arcuate vertical sides 12 and 14. As may be seen, sides 10, 12, 13 and 14 are preferably, but not necessarily, slightly angled from vertical. A radius of the arcuate vertical side 12 is preferably, but not necessarily, less than a radius of the arcuate side 14. Together with an upper surface 16, these sides 10–14 define a generally elongate body 15 with an interior space 17 (see FIG. 2), the elongate body 15 having an inner perimeter 102. As seen in FIG. 5, the upper surface 16 defines a first slightly tapered cylindrical depression 18 and a second slightly tapered cylindrical depression 20.

The first depression 18 is divided into an upper and lower tapered sections 122 and 124, a lowest portion 123 of the upper tapered section 122 having a slightly larger radius than a highest portion 125 of the lower tapered section 124. A first annular horizontal ledge 126 is located between the upper tapered section 122 and the lower tapered section 124.

Similarly, the second depression 20 is divided into an upper and lower tapered cylindrical sections 128 and 130, a lowest portion 129 of the upper tapered section 128 having a slightly larger radius than a highest portion 131 of the lower tapered section 130. A circular disc 170 preferably rests on a second annular horizontal ledge 132 between the upper tapered section 128 and the lower tapered section 130 of the second depression 20. The circular disc 170 separates the upper tapered section 128 from the lower tapered section 130.

Figure 2:
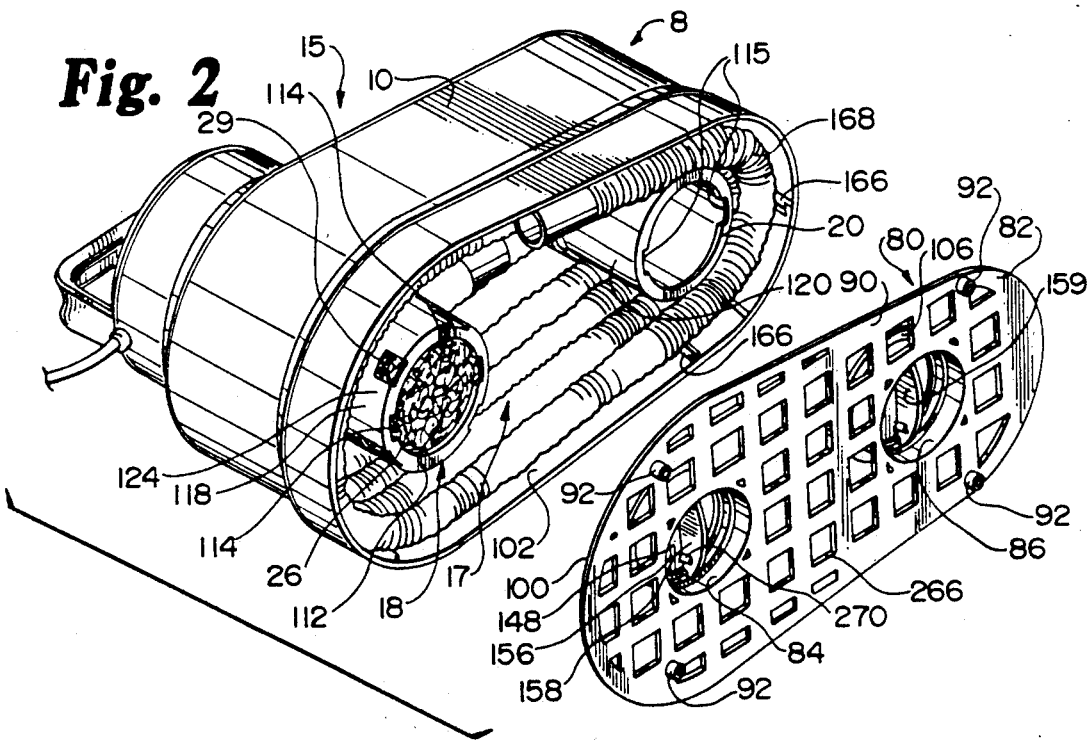
FIG. 2 is a perspective view of the housing showing the bottom panel removed and hose storage within the housing.

As shown in FIG. 2, a cylindrical surface 118 of the first depression 18 is disposed within the interior space 17. Likewise, a cylindrical surface 120 of the second depression 20 is disposed within interior space 17. The upper cylindrical section 128 of second depression 20, as seen in FIG. 1, is adapted and designed for removable retention of a spray gun assembly (not shown).

As shown in FIG. 5, the first depression 18 is adapted and designed to retain a fan motor 24. A filter 26 is preferably disposed within the lower section 124 of the first depression 18 to filter air before the air enters the fan motor 24. The filter 26 is disposed beneath a bottom vented filter cup 172 having an upper rim 176 which rests on the first horizontal ledge 126. A tubular gasket 178 rests between the fan motor 24 and the filter cup upper rim 176. The filter cup 172 extends about half way into the lower section 124. As shown in FIG. 2, the lower section 124 of the first depression 18 is vented with a first set of vents 29 to allow entry of air into the depression 18 in response to the vacuum created by the fan motor 24. The sides 10–14 are provided with a second set of vents 31 (FIGS. 1 and 4) to allow air flow from outside the housing 8 to reach the fan motor 24 through the second set of vents 31 and then through the first set of vents 29 and the filter 26 in response to a vacuum created by operation of the fan motor 24. (FIGS. 2 and 4). Polyurethane foam has been found to be a suitable material for filter 26. It is also to be understood that the air inlet for motor 24 is a central opening in its lower or bottom wall.

Referring again to FIG. 3, an annular gasket 28 of a suitable resilient material is located over a motor positioning plate 30 having an outer rim 268 preferably secured to the fan motor 24 such as by screws 31 with another gasket 33 of suitable resilient material located between plate 30 and motor 24 to produce a substantially air-tight seal therebetween. An inner dome 32 having a circular opening 34 is located over the annular gasket 28 to produce a substantially air-tight seal therebetween. An outer dome 36 is located over the inner dome 32. As is also shown in FIG. 6, the outer dome 36 defines a threaded bore 38 into which an externally threaded fitting 40 is screwed. An interior end 42 of the fitting 40 is adapted and designed to rest within the circular opening 34 of the inner dome 32 with a relatively air-tight seal between fitting 40 and inner dome 32 when the fitting 40 is threaded into the bore 38. A smooth surface 136 of a slightly tapered cylindrical section 234 located at the interior end 42 of the fitting 40 which is disposed within the circular opening 34 preferably creates the air-tight seal. An exterior end 43 of the fitting 40, which extends out of the threaded bore 38 of the outer dome 36, preferably has an exterior perimeter section 45 with wrench flats thereon. The fitting 40 defines a cylindrical passage 47 which communicates between the interior end 42 and the exterior end 43 of the fitting 40. The interior end 42 preferably has a grill 49 disposed across the cylindrical passage 49.

Referring now more particularly to FIG. 3, the outer dome 36, inner dome 32, annular gasket 28 and the motor positioning plate 30 are secured to the upper surface 16 surrounding the first depression 18 with screws 44. The screws 44 are received in holes 180 in an annular base 46 of the outer dome 36, holes 181 in an annular bottom plate 48 of the inner dome 32, holes 182 in the annular gasket 28, holes 183 in an annular rim 268 of the motor positioning plate 30 and holes 184 in the upper surface 16 around the first depression 18. As seen in FIG. 6, a downwardly extending circumferential lip 50 on the annular base 46 of the outer dome 36 covers the annular bottom plate 48 and the annular gasket 28. This construction causes air flow from the fan motor 24 to be directed into the inner dome 32, through the passage 47 of the fitting 40 with only a single turn of 90° in the air path.

Referring back to FIG. 3, the inner dome 32 is preferably formed of the annular bottom plate 48, a cylindrical center section 238, an upper section 244 and a horizontally disposed, slightly arched top portion 258. The cylindrical center section 238 extends upwardly from an inner edge 240 of the annular bottom plate 48. An upper end 242 of the cylindrical central section 238 has two horizontal portions 243 extending inwardly therefrom. Two vertical arcuate walls 246 extend vertically from the cylindrical central section 238. Two panel walls 248 extend upwardly between the arcuate walls 246 from an innermost edge 250 of each of the two horizontal portions 243. The panel walls 248 are comprised of a planar lower section 252 having a slight inward incline and an upper section 254 extending upwardly from an upper edge 256 of each planar lower section 252. The upper sections 254 preferably have a greater inward incline than the lower sections 252 as may be seen most clearly in FIG. 5. The arcuate walls 246 and the panel walls 248 are capped by the generally horizontally disposed top portion 258. One of the two arcuate walls 246 defines the circular opening 34 generally centered between the panel walls 248.

The outer dome 36 is preferably formed of an annular base 46, a slightly tapered cylindrical middle portion 262, and a convex ceiling portion 264.

Referring back to FIG. 3, the cylindrical middle portion 262 of the outer dome 36 extends upwardly from the inner circumference of the annular base 46. The ceiling portion 264 is located above and closes the cylindrical middle portion 262.

Referring to FIGS. 4 and 5, the outer dome 36 is preferably provided with an over-arching handle 72 disposed at a right angle to the threaded bore 38. The handle 72 has a first handle end 74 disposed near a first end 76 of the elongate body 15 and a second handle end 75 disposed between the first end 76 of the elongate body 15 and a second end 77 of the elongate body 15 near a center 78 of the elongate body 15. As seen in FIG. 3, the outer dome 36 also has an indentation 51 in its upper surface, the indentation 51 having a vertical wall 52 and a horizontal floor 54. FIG. 5 shows that the horizontal floor 54 has a switch opening 58 defined therein having an on-off switch 56 disposed therein. The on-off switch 56 has first and second sets of leads 62, 64 disposed within the outer dome 36. The first set of leads 62 also passes through the inner dome 32 through a lead opening 60 (shown in FIG. 3) in the inner dome 32 and connects to the fan motor 24. The lead opening 60 in the inner dome 32 is preferably sealed after the first set of leads 62 is inserted to make the lead opening 60 air-tight. Silicone caulk 186 has been found to be a suitable material for sealing opening 60. The second set of leads 64 connects the on-off switch 56 and an electrical cord 66. Referring to FIG. 5, the outer dome 36 defines an electrical cord opening 68 disposed beneath the first handle end 74 of the over-arching handle 72 in which a strain relief connector 70 is received. A set of cord connectors "C" connects the second set of leads 64 within the outer dome 36 to the electrical cord 66.

Figure 2A:
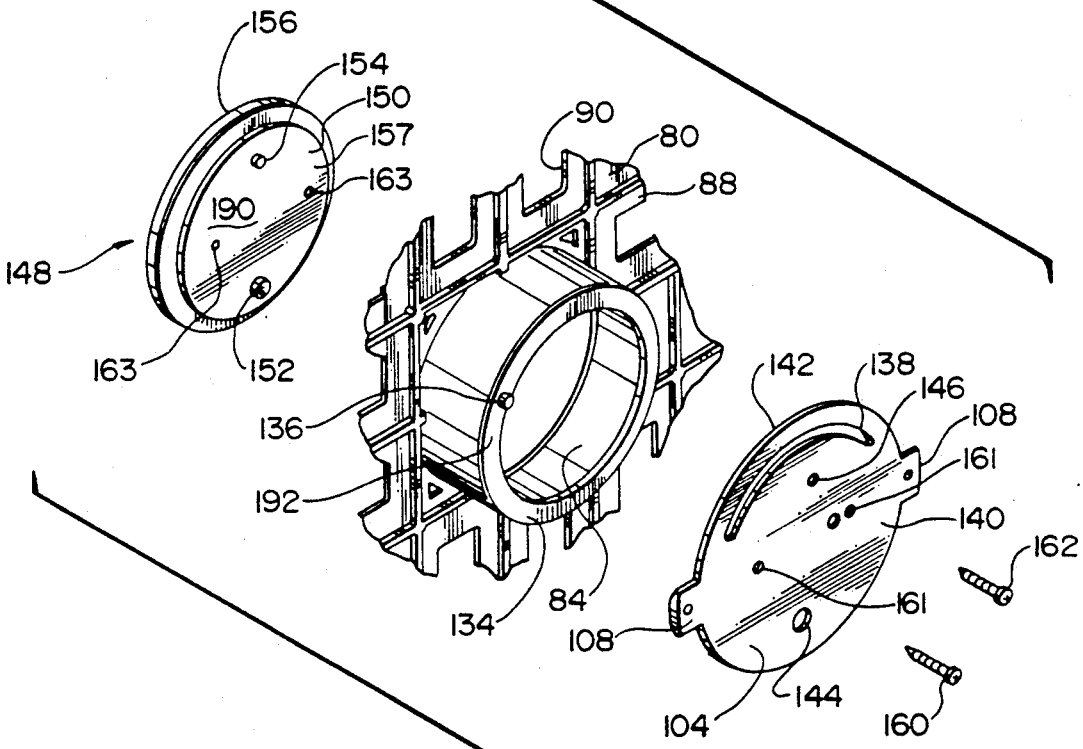

Referring now to FIGS. 2, 2*a*, and 5 the housing 8 is preferably provided with a bottom cover 80 having a generally planar section 82 and a first and second cylindrical well sections 84 and 86. The generally planar section 82 defines a waffle-like patterned grate of venting holes 266 communicating between a top 88 and bottom 90 of the bottom cover 80. The bottom 90 of the bottom cover 80 also has four support feet 92 disposed thereon. An outer perimeter 100 of the bottom cover 80 is adapted and designed to fit within the inner perimeter 102 of the elongate body 15 with the first and second cylindrical well sections 84 and 86 disposed upwardly and aligned with the first and second depressions 18 and 20 of the elongate body 15 respectively.

Disposed above the first cylindrical well section 84 is a first circular rotatable top plate 104 having a circumference slightly greater than a respective outer circumference of the first cylindrical well section 84. The first top plate 104 is provided with two horizontal beveled flanges 108 extending along a diameter of the first top plate 104. The first top plate 104 is disposable within a first annular bottom rim 112 of the first depression 18. The first annular bottom rim 112 of the first depression 18 defines two diametrically opposed notches 114 adapted and designed to receive the beveled flanges 108. Thus, the first top plate 104 is rotatable to position the beveled flanges 108 for insertion into radial notches 114 in the first annular bottom rim 112 of the first depression 18. Upon such insertion, the top plate 104 may be rotated up to 90 degrees. Upon rotation of the first top plate 104, the horizontal beveled flanges 108 are no longer aligned with the radial notches 114 and the first top plate 104 is retained within the first depression 18 against the first annular bottom rim 112 by the flanges 108.

The first cylindrical well section 84 preferably has a first annular backing lip 134 having a smaller inner radius than an inner radius of the first cylindrical well section 84. A first cylindrical blocking peg 136 extends upwardly from the first backing lip 134. The first top plate 104 defines a first arcuate channel 138 communicating between a front surface 140 and a back surface 142 of the first top plate 104. The arc of the first arcuate channel 138 is concentric with the first top plate 104. The first blocking peg 136 is disposed within the first arcuate channel 138 and limits axial rotation of the first top plate 104 to a range of 90 degrees.

A first backing disc 148 is disposed below the first top plate 104. The first backing disc 148 has a radius greater than the inner radius of the first annular backing lip 134, and less than the inner radius of the first cylindrical well section 84. As may be seen in FIGS. 2 and 5, a lower surface 156 of the first backing disc 148 is provided with a first blade 158 along a diameter of the first backing disc 148. An upper surface 157 of the first backing disc 148 has a raised center section 150 concentric with the first backing disc 148. The raised center section 150 has a radius slightly less than the inner radius of the first annular backing lip 134. Raised center section 150 has a thickness slightly greater than a thickness of a top surface 190 of the first annular backing lip 134 of the first cylindrical well section 84 such that when a top surface 190 of the first backing disc 148 is secured to top plate 104 by a pair of screws 160, 162, the assembly of disc 148 and top plate 104 is free to rotate with respect to lip 134.

The top surface 190 of the first raised center section 150 is provided with a pair of interlock pegs 152, 154 having a larger radius and a smaller radius respectively, upwardly extending from and symmetrically disposed on the raised center section 150 along a diameter of the raised center section 150. The first top plate 104 defines a larger interlock hole 144 and a smaller interlock hole 146 symmetrically disposed along a diameter of the first top plate 104. The larger and smaller interlock pegs 152, 154 are positioned for insertion into the larger and smaller interlock holes 144, 146 respectively. Such an interlocking peg and hole arrangement insures correct assembly of the first top plate 104 with the first backing disc 148.

Referring to FIG. 2a, the first top plate 104 is preferably affixed to the first backing disc 148 with first and second screws 160, 162 received through screw holes 161 in the top plate 104 and secured in screw holes 163 in the first backing disc 148. First blade 158 is aligned over a pair of bosses 270 containing screw holes 163 to provide additional strength.

Referring to FIGS. 2 and 5, the second cylindrical well section 86 is removably attachable to the second depression 20 using a second top plate 106 having a second pair of beveled flanges (not shown) inserted into a second pair of radial notches 115 in the same manner in which the first top plate 104 of the cylindrical well section 84 is removably attachable to the first depression 18.

As shown in FIG. 2, the inner perimeter 102 of the elongate body 15 is preferably provided with a set of bottom stop ridges 166 to rest against the bottom cover 80 and prevent the bottom cover 80 from deflecting inward into the interior space 17 of body 15.

An air hose 168 is storable within interior space 17 by wrapping the hose 168 around the cylindrical surfaces 118, 120 of the first and second depressions 18, 20 and then attaching bottom cover 80 to body 15 by inserting both pairs of horizontal beveled flanges 108, (not shown), into their respective pairs of radial notches 114, 116 and rotating the first blade 158 and a second blade 159 to secure the bottom cover 80 in place.

Although the present invention has been described with reference to preferred embodiments, workers skilled in the art will recognize that changes may be made in form and detail without departing from the spirit and scope of the invention.

What is claimed is:

1. An improved air flow structure for a portable painting apparatus comprising:

a) a fan motor assembly having an air outlet delivering air generally axially along an axis of the motor as the air exits the fan motor assembly;

b) a cover disposed over the air outlet of the fan motor assembly, the cover defining a generally rectangular air plenum having a pair of elongated side walls and a pair of short end walls at the air outlet, an arched top wall, and a circular air exit aperture in one of the end walls of the rectangular air plenum such that air exiting the fan motor assembly passes immediately into the air plenum and exits the plenum at substantially a right angle to the motor axis.

2. The air flow structure of claim 1 wherein the elongated side walls angle inwardly toward each other as they approach the top wall.

3. The air flow structure of claim 2 wherein the end walls are arcuate.

4. The air flow structure of claim 3 wherein the arcuate end walls angle inwardly toward each other as they approach the top wall.

5. A hose storage apparatus for portable painting equipment comprising:

a) a hollow fan motor housing having a generally oval vertical cross section and an opening on the bottom thereof; and b) a bottom cover releasable securable to the bottom of the housing to close the opening wherein an air hose is storable in the hollow fan motor housing and is retained therein when the bottom cover is secured to the housing.

6. The hose storage apparatus of claim 5 wherein the fan motor housing further comprises a pair of depressions extending into the hollow region interior of the housing.

7. The hose storage apparatus of claim 6 wherein the bottom cover is secured to the housing by interlocking rotatable projecting flanges in the bottom cover received in notches in the depressions.

8. The hose storage apparatus of claim 5 wherein the hollow fan motor housing further comprises:

i) an upper surface;

ii) a first depression positioned in the upper surface toward a first end of the housing, the first depression having a fan motor received therein, the first depression further having venting means to permit entry of air into the first depression;

iii) the upper surface having a second depression adapted and designed to removably retain a spray gun; and iv) an interior space defined between an inner surface of the housing and the first and second depressions, such that an air hose is storable in the housing within the interior space with the air hose coiled around the first and second depressions.

9. A fan motor housing for a portable paint spray gun apparatus according to claim 8 wherein a bottom of the hollow body is removably affixed by fastening means to a bottom cover for retaining the air hose within the interior space.

10. A fan motor housing for a portable paint spray gun apparatus according to claim 8 wherein a bottom cover of the hollow body is provided with venting passages communicating between a top and a bottom of the bottom cover to allow air flow through the bottom cover.

11. A fan motor housing for a portable painting apparatus comprising:

a generally hollow elongated housing body, having an upper surface, the upper surface having a first depression, the first depression adapted and designed to contain a fan motor the first depression having venting means to allow entry of air into the first depression;

b) an inner dome disposed over the first depression and affixed with substantially air-tight means to the elongate housing body for preventing escape of air therebetween, the inner dome having a generally vertical portion defining a circular opening;

c) a generally cylindrical fitting defining a passage communicating between an interior end and an exterior end of the fitting, the fitting having a slightly tapered cylindrical section disposed at the interior end of the fitting, the interior end of the fitting having a smooth surface adapted and designed to fit with a substantially air-tight seal within the opening of the inner dome; and d) an outer dome disposed and affixed over the inner dome, the outer dome defining a bore aligned with the circular opening of the inner dome, the bore adapted and designed to retain the cylindrical fitting with the interior end of the fitting positioned within the circular opening of the inner dome:

such that air flow exiting the fan motor is directed into the inner dome and then out through the passage of the fitting.

12. The fan motor housing for a portable paint spray gun apparatus according to claim 11 wherein the hollow housing body further comprises a second depression and four generally vertical sides such that an air hose is storable within the elongate housing body within a space defined between the sides and the first and second depressions with the air hose coiled around the first and second depressions.

13. A fan motor housing for a portable paint spray gun apparatus according to claim 11 wherein the interior end of the fitting has a grill disposed across the passage.

14. A fan motor housing for a portable paint spray gun apparatus according to claim 11 wherein the inner dome comprises:

a) an annular bottom plate;

b) a cylindrical central section positioned to extend upwardly from an inner edge of the annular bottom plate, an upper end of the cylindrical central section having two horizontal portions symmetrical with each other positioned to extend inwardly from the upper end of the cylindrical central section; and c) an upper section having:

i) two vertical arcuate walls being upwardly extending continuations of the cylindrical central section;

ii) two panel walls disposed symmetrically with each other, each of the panel walls having a generally planar lower section extending upwardly with a slight inward incline from an innermost edge of one of the two horizontal portions, each of the planar lower sections having an upper section extending from an upper edge of each of the planar lower sections, the upper sections having a slightly greater inward incline than the planar lower sections; and iii) a generally horizontally disposed top portion capping the arcuate walls and the panel walls;

with one of the two vertical arcuate walls defining the circular opening for receiving the fitting, the circular opening generally centered between the top portion and the annular bottom plate and between the panel walls.

15. A fan motor housing for a portable paint spray gun apparatus according to claim 11 wherein the outer dome comprises:

a) an annular base having a downwardly disposed circumferential lip adapted and designed to overlap an outer edge of the annular bottom plate of the inner dome;

b) a slightly tapered cylindrical middle portion extending upwardly from the inner circumference of the annular base; and c) a ceiling portion disposed to close an upper end of the cylindrical middle portion.

16. A fan motor housing for a portable paint spray gun apparatus according to claim 11 wherein the airtight means for affixing the inner dome to the upper surface of the elongate body comprises attachment of the outer dome and the inner dome with screws onto the upper surface of the elongate body with an annular gasket positioned between the inner dome and a rim of a motor positioning plate attached to the fan motor, the rim disposed on the upper surface under the gasket.

17. A fan motor housing for a portable paint spray gun apparatus according to claim 11 wherein the elongate body further comprises a second depression and is adapted and designed to receive and retain a removable bottom cover to enclose the interior space between the walls and the first and second depressions, the bottom cover having fasten means for removable attachment of the bottom cover to the first and second depressions in the elongate body.

18. A fan motor housing for a portable paint spray gun apparatus according to claim 17 wherein the fastening means for removable attachment of the bottom cover to the first and second depressions comprises:

a) an annular bottom rim integral with the first depression, the annular bottom rim having at least two diametrically opposed notches;

b) at least one cylindrical well section located on the top of the bottom cover, the cylindrical well section having an annular backing lip, the backing lip having at least one upwardly extending blocking peg;

c) a generally circular rotatable top plate having a circumference slightly less than an inner circumference of the annular bottom rim, the top plate having at least two beveled flanges extending along a diameter of the top plate, the beveled flanges adapted and designed for insertion into the diametrically opposed notches of the annular bottom rim, the top plate defining an arcuate channel between a front surface and a back surface of the top plate, an arc of the arcuate channel concentric with the top plate;

d) a backing disc having a radius greater than the inner radius of the annular backing lip, but less than the inner radius of the cylindrical well section, a lower surface of the backing disc provided with a blade located along a diameter of the backing disc, the backing disc also having a first raised section concentric with the backing disc, the raised section having a radius slightly less than the inner radius of the first annular backing lip, the raised section having a thickness slightly greater than a thickness of the annular backing lip;

e) at least two interlock pegs extending upwardly from the raised center section each blocking disposed within a corresponding interlock hole each interlock hole disposed in the top plate such that rotation of the backing disc causes rotation of the top plate;

f) means for affixing the top plate to the backing disc with the annular backing lip disposed between the top plate and the backing disc with the blocking peg disposed within the arcuate channel to limit the rotation of the top plate and the bottom plate on the well section such that the bottom cover is removably retainable on the bottom rim through insertion of the beveled flanges into the notches and rotation of the backing disc.

19. A fan motor housing for a portable paint spray gun apparatus according to claim 17 wherein the bottom cover of the elongate body is provided with venting passages communicating between a top and a bottom of the bottom cover.

* * * * *